US005343535A

United States Patent [19]

Marshall

[11] Patent Number: 5,343,535

[45] Date of Patent: Aug. 30, 1994

[54] LOUDSPEAKER DEVICE

[76] Inventor: Ronald N. Marshall, 2908 Payne Rd., Des Moines, Iowa 50310

[21] Appl. No.: 57,893

[22] Filed: May 7, 1993

[51] Int. Cl.[5] ..... H04R 25/00

[52] U.S. Cl. ..... 381/159; 381/90; 181/144

[58] Field of Search ..... 381/159, 165, 205, 182, 381/186, 24, 156, 88, 90, 154, 153, 89, 188; 181/144, 145, 152, 156, 199

[56] References Cited

U.S. PATENT DOCUMENTS

| | | | |
|---|---|---|---|
| 3,131,783 | 5/1964 | Mares | 181/145 |
| 3,729,061 | 4/1973 | Tamura . | |
| 3,898,384 | 8/1975 | Goeckel | 181/152 |
| 4,064,966 | 12/1977 | Burton | 181/144 |
| 4,268,719 | 5/1981 | Manger | 381/89 |
| 4,805,221 | 2/1989 | Quaas | 381/90 |
| 5,073,945 | 12/1991 | Kageyama et al. | 381/186 |
| 5,105,905 | 4/1992 | Rice | 381/160 |
| 5,111,905 | 5/1992 | Rodgers | 181/152 |

*Primary Examiner*—Curtis Kuntz
*Assistant Examiner*—Huyen D. Le
*Attorney, Agent, or Firm*—Henderson & Sturm

[57] ABSTRACT

This invention is an audio frequency loudspeaker device with characteristics of broad frequency response, high efficiency, and simplicity. These qualities are achieved by the novel combination of a resonant pipe and an audio transducer dipole.

6 Claims, 1 Drawing Sheet

LOUDSPEAKER DEVICE

BACKGROUND OF THE INVENTION

1. Field

The invention is a device for the efficient propagation of high fidelity sound from an audio frequency electrical signal.

2. Prior Art

For comparison purposes, one may refer to other devices in the same field. First is a device shown in U.S. Pat. No. 5,073,945. It is a dipole type device built into a sealed box and uses an electrical crossover. Second is a device shown in U.S. Pat. No. 4,268,719. It is also a dipole type device within a closed housing, but with no crossover network. Third is a device described in U.S. Pat. No. 3,729,061. It could be shown to be a folded resonant pipe with one transducer located concentrically at one open end. Number four is represented in U.S. Pat. No. 5,111,905. It is a folded closed end resonant pipe with one transducer mounted tangent to the approximate centerline of the pipe. Fifth is shown in U.S. Pat. No. 5,105,905 and is essentially a resonant pipe with a concentrically mounted transducer and reflectors mounted at each end to redirect the propagated sound. Finally, number six is shown U.S. Pat. No. 4,064,966. It could be shown to be a closed dipole type arrangement concentrically installed on the end of a folded resonant pipe.

SUMMARY OF THE INVENTION

My invention is a loudspeaker device which incorporates an open acoustic dipole arranged to be both tangent and concentric to a folded resonant pipe.

BRIEF DESCRIPTION OF THE DRAWINGS

In illustration of my invention, I have provided drawings listed as FIGS. 1 through 7. They are all representative of the preferred embodiment.

In all figures, letter "a" refers to transducers. In all figures, letter "b" refers to the tongue of the baffle. In all figures, "c" refers to the baffle assembly. In all figures, "d" refers to the enclosure. In FIGS. 6 and 7, letter "e" refers to deflectors. In FIG. 6, there are also numbers 1 and 2 which show the installed transducers.

DETAILED DESCRIPTION

The loudspeaker device of my invention is a combination of two elements. These are audio electric transducers and an enclosure box or resonant pipe.

Figure 1:
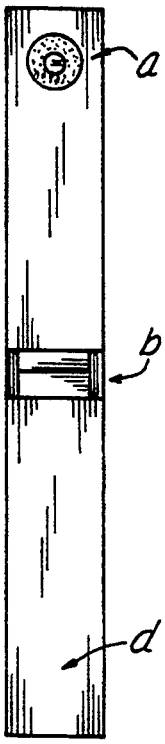
FIG. 1 shows a plane front view.
Figure 2:
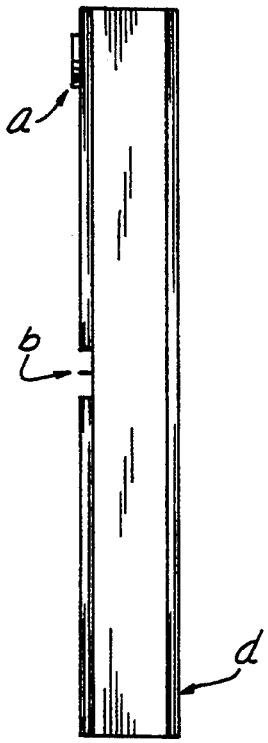
FIG. 2 is a plane side view of either side.
Figure 3:
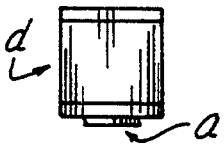
FIGS. 3 and 4 are plane top and bottom views.
Figure 4:
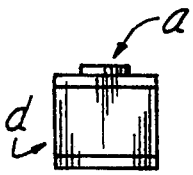
Figure 5:
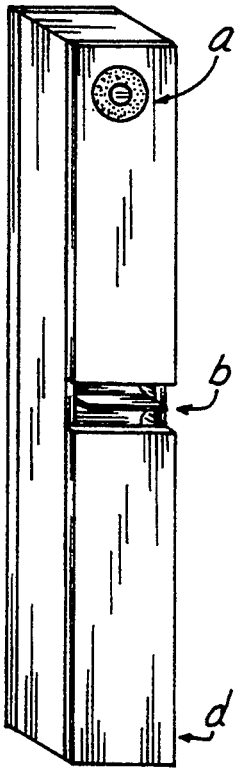
FIG. 5 is an isometric view showing front, side and top.
Figure 6:
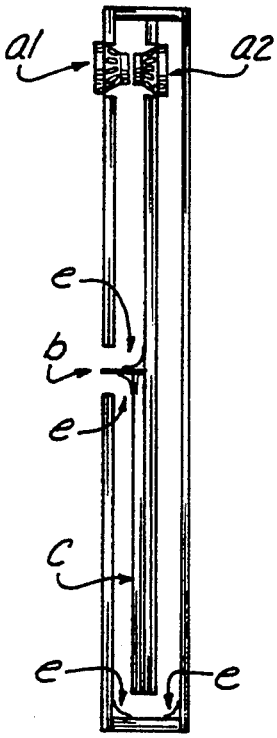
FIG. 6 is a vertical cross-section of the view shown in FIG. 2.

The transducers are full range type, and used in pairs. They are electrically connected either in series or parallel and the connections are in phase. The transducers, as can be seen at "a1" and "a2" of FIG. 6, are installed back to back and concentrically to each other. This arrangement comprises an open acoustic dipole.

An open acoustic dipole, by itself, has no useful output. In this lies the importance of the box or pipe. The box is constructed of any suitable high density material and appropriate method of assembly. There is an internal divider or baffle which functionally causes the box to become a folded resonant pipe. The round openings in the box and baffle allow the installation of transducers. The divided rectangular opening in the front becomes both open ends of the resonant pipe.

The pipe in other embodiments could have round or oval or other cross section, in which case the invention might not have the same external appearance. It is necessary, however, to be folded as in this embodiment. There are two reasons: First, the folds cause the correct number of phase shifts, and second, the dipole must be installed in a fold. The correct number of folds allow all the propagated sound to be additive. The dipole when so mounted, will propagate energy both internally and externally to the resonant pipe.

Specific dimensions of this embodiment are not given because of the many combinations possible. I will, however, describe the aspects of dimensional limitations. There are two kinds of factors involved. First are those which affect acoustic performance indirectly because of the dimensions of the transducers. Second are those caused by the nature of acoustic vibrations.

Three aspects of transducer dimensions are considered. First, frame width restricts the minimum width of the enclosure. Second, frame height is a consideration in the space where the transducers "a1" and "a2" of FIG. 6 are back to back. Third is the piston or cone area. It is necessary that piston area nearly match the cross sectional area of the pipe. In the space mentioned above where transducers are back to back, both transducers' cone areas are additive. Also noteworthy, transducers are usually considered to have a smaller piston area from the back. The remaining pipe length is driven by the front side of only transducer "a2", therefore, those dimensions can be more easily matched to the cone area.

The first limitation on pipe dimensions due to acoustic limit is the need for correct proportion of pipe length on either side of the point of energy injection. Practice has shown that odd number ratios are required to either add or remove energy in a waveguide. Waveguide being analogous to resonant pipe, therefore indicates use of proportions one to three. This is closely achieved in this box enclosure embodiment by locating the rectangular hole in the front, where the ends of the pipe terminate, at a distance half way between top and bottom. The internal height of the box is equal to one half of the quarter wave of the primary resonance frequency. The prototype of this embodiment was constructed four feet tall and is therefore theoretically capable of sound reproduction down to thirty two cycles.

Figure 7:
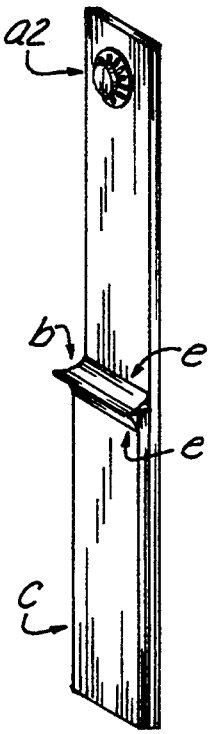
FIG. 7 is an isometric of the uninstalled internal divider or baffle. There is no back view included because it is featureless.

The internal baffle, "c" in FIG. 6 and 7, is constructed so that it has the necessary features to make a box become a folded pipe. There is a hole to mount the transducer frame near as possible to the top. The bottom portion is laminated of the same or similar material in order to increase in thickness. The extra thickness is required in order to maintain a consistent cross-section in that portion of the pipe. The bottom of the baffle is made short of the bottom of the box. The reason is to provide a passage for continuation of the pipe from back to front. There is also a tongue attached to be vertically centered in the bottom front opening. The tongue has the purpose of causing the final 90 degree turns needed to give the total 360 degree phase shift.

Each fold or turn of 90 degrees throughout the entire pipe length constitutes a 90 degree phase shift of the sound, and is required in all embodiments.

Finally, deflectors are installed in this embodiment but may not be needed in other embodiments. Their purpose is to prevent reflection within the pipe and help make pipe dimension more uniform.

The internal height of the box is equal to one half of the quarter wave of the primary resonant frequency. The prototype of this embodiment was constructed four feet tall and therefore is theoretically capable of sound reproduction down to thirty two cycles. One half of the dipole, that is, transducer number "a1", partially radiates directly into the listening space. The upper limit of frequency response is thereby determined. Because high frequencies are dissipated within a low frequency pipe, the internal transducer "a2", supplies mostly low frequency sound. Four inch diameter commercially available transducers were chosen because the upper response is up to twenty thousand cycles.

The net benefit of the back to back transducer combination is due to the dynamic dampening of this dipole arrangement which occurs in the space between them. This allows efficiently propagated sound energy at frequencies below the transducer's rated normal lower limits. Resonant amplification at these low frequencies is caused by the pipe, this allows overall frequency response of the invention to include nearly the entire spectrum of human hearing.

I claim: invention of a loudspeaker device comprised of at least one matched pair of full range audio electric transducers configured to make an open acoustic dipole, combined with an enclosure formed to make a folded resonant pipe. The total constitutes an open acoustic dipole augmented by an open resonant pipe, which efficiently and accurately produces and propagates audio energy from an audio frequency electrical signal.

1. A loudspeaker system, comprising:

a folded resonant pipe having a predetermined length and including a first end and a second end open to a listening space, the pipe including a plurality of 90° folds disposed between the first and second ends; and a pair of full range audio electric transducers electrically connected in phase, each of the transducers including a front surface and a back surface for radiating sound waves, the pair of transducers being mounted within the pipe in back-to-back coaxial relationship at one of said 90° folds and disposed such that one of the transducers is directed through a mounting opening in the pipe in communication with the listening space and wherein the other transducer has both its surfaces in communication with the pipe.

2. The loudspeaker system of claim 1 wherein the pair of transducers are mounted at a 90° fold of the pipe located at a position between the first and second ends wherein the ratio of distances from the transducers to the first end and the second end is a ratio greater than one to one.

3. The loudspeaker system of claim 2 wherein the ratio is one to three.

4. A loudspeaker system, comprising:

an enclosure including end panels, side panels attached to and interconnecting the end panels, a rear panel attached to one edge of the end and side panels, a front panel attached to another edge of the end and side panels, a baffle attached to the side panels and disposed between the front panel and the rear panel and spaced from the end panels, the front panel including an opening midway between the end panels defining both a first end and a second end open to a listening space, and a tongue member attached to the baffle and disposed to extend out bisecting the opening, the enclosure forming a folded resonant pipe including a plurality of 90° folds; and a pair of full range audio electric transducers electrically connected in phase, each of the transducers including a front surface and a back surface for radiating sound waves, the pair of transducers being mounted within the pipe in back-to-back coaxial relationship at one of said 90° folds and disposed such that one of the transducers is directed through a mounting opening in the pipe in communication with the listening space and wherein the other transducer has both its surfaces in communication with the pipe.

5. The loudspeaker system of claim 4 wherein the pair of transducers are mounted at a 90° fold of the pipe located at a position between the first and second ends wherein the ratio of distances from the transducers to the first end and the second end is a ratio greater than one to one.

6. The loudspeaker system of claim 5 wherein the ratio is one to three.

* * * * *